US006461042B1

(12) United States Patent
Tomic et al.

(10) Patent No.: US 6,461,042 B1
(45) Date of Patent: Oct. 8, 2002

(54) RESEALABLE CLOSURE MECHANISM HAVING A SLIDER DEVICE

(75) Inventors: Mladomir Tomic; Michael E. Schreiter, both of Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/695,822

(22) Filed: Oct. 25, 2000

Related U.S. Application Data

(60) Provisional application No. 60/226,507, filed on Aug. 21, 2000, and provisional application No. 60/200,989, filed on May 1, 2000.

(51) Int. Cl.[7] ..... B65D 33/25

(52) U.S. Cl. ..... 383/64; 383/61.2; 24/399; 24/400

(58) Field of Search ..... 383/61, 63, 64, 383/61.2; 24/399, 400

(56) References Cited

U.S. PATENT DOCUMENTS

| | | | | |
|---|---|---|---|---|
| 3,115,689 A | | 12/1963 | Jacobs | |
| 3,122,807 A | | 3/1964 | Ausnit | |
| 3,173,184 A | | 3/1965 | Ausnit | |
| 3,220,076 A | * | 11/1965 | Ausnit et al. | 24/399 |
| 3,266,112 A | * | 8/1966 | Heckman | 24/400 |
| 3,324,520 A | | 6/1967 | Ausnit | |
| 3,633,642 A | | 1/1972 | Siegel | |
| 3,713,923 A | | 1/1973 | Laguerre | |
| 4,262,395 A | | 4/1981 | Kosky | |
| 4,335,817 A | | 6/1982 | Bahr | |
| 4,337,889 A | | 7/1982 | Moertel | |
| 4,561,108 A | | 12/1985 | Kamp | |
| 4,620,320 A | | 10/1986 | Sullivan | |
| 4,710,968 A | | 12/1987 | Borchardt et al. | |
| 4,883,329 A | | 11/1989 | Flannery et al. | |
| 4,890,935 A | | 1/1990 | Ausnit et al. | |

(List continued on next page.)

FOREIGN PATENT DOCUMENTS

| | | |
|---|---|---|
| FR | 1 299 797 | 6/1962 |
| FR | 2 617 022 | 12/1988 |
| WO | WO 99/62780 | 12/1999 |
| WO | WO 99/62781 | 12/1999 |
| WO | WO 99/65353 | 12/1999 |

*Primary Examiner*—Jes F. Pascua
(74) *Attorney, Agent, or Firm*—Julie R. Daulton; Tracey D. Beiriger

(57) ABSTRACT

A closure arrangement for use with a flexible package includes a first closure mechanism, a slider device, and a second closure mechanism. The first closure mechanism includes selectively engageable first and second profiles. The slider device has a housing operably mounted on the first closure mechanism. The slider housing is constructed and arranged to engage and disengage the first and second profiles. The slider housing defines a first cavity that slidably receives said first and second profiles. The second closure mechanism includes selectively engageable third and fourth profiles. The second closure mechanism is adjacent to the first closure mechanism but is completely outside of the first cavity. The second closure mechanism may be either a single pair of interlocking hooks, or may be multiple members. The slider device includes a plow with a non-rectangular cross-section, such as a polygon, a racetrack, or a circle. The plow may also include shoulders to help retain the slider device on the first closure mechanism.

18 Claims, 4 Drawing Sheets

U.S. PATENT DOCUMENTS 4,944,072 A 7/1990 Robson
5,007,142 A 4/1991 Herrington
5,007,143 A 4/1991 Herrington
5,010,627 A 4/1991 Herrington et al.
5,020,194 A 6/1991 Herrington et al.
5,063,644 A 11/1991 Herrington et al.
5,067,208 A 11/1991 Herrington, Jr. et al.
5,070,583 A 12/1991 Herrington
5,088,971 A 2/1992 Herrington
D325,547 S 4/1992 Saito et al.
5,131,121 A 7/1992 Herrington, Jr. et al.
5,140,796 A 8/1992 Pope
5,161,286 A 11/1992 Herrington, Jr. et al.
5,167,608 A 12/1992 Steffens, Jr. et al.
5,189,764 A 3/1993 Herrington et al.
5,211,482 A 5/1993 Tilman
5,283,932 A 2/1994 Richardson et al.
5,301,394 A 4/1994 Richardson et al.
5,301,395 A 4/1994 Richardson et al.
5,405,478 A 4/1995 Richardson et al.
5,426,830 A 6/1995 Richardson et al.
5,431,760 A 7/1995 Donovan
5,442,837 A 8/1995 Morgan
5,442,838 A 8/1995 Richardson et al.
5,448,807 A 9/1995 Herrington, Jr.
5,448,808 A 9/1995 Gross
5,482,375 A 1/1996 Richardson et al.
5,577,305 A 11/1996 Johnson
5,636,415 A 6/1997 James
5,636,783 A 6/1997 Preston
5,638,586 A 6/1997 Malin et al.
D380,988 S 7/1997 Mizuno
5,664,299 A 9/1997 Porchia et al.
5,669,715 A 9/1997 Dobreski et al.
5,681,115 A 10/1997 Diederich et al.
5,682,730 A 11/1997 Dobreski
5,689,866 A 11/1997 Kasai et al.
5,713,669 A 2/1998 Thomas et al.
5,722,128 A 3/1998 Toney et al.
5,769,772 A 6/1998 Wiley
5,775,812 A 7/1998 St. Phillips et al.
5,788,378 A 8/1998 Thomas
5,833,791 A 11/1998 Bryniarski et al.
5,851,070 A 12/1998 Dobreski et al.
5,867,875 A 2/1999 Beck et al.
5,871,281 A 2/1999 Stolmeier et al.
5,896,627 A 4/1999 Cappel et al.
5,911,508 A 6/1999 Dobreski et al.
5,924,173 A 7/1999 Dobreski et al.
5,938,337 A 8/1999 Provan et al.
5,956,924 A 9/1999 Thieman
5,964,532 A 10/1999 St. Phillips et al.
5,996,187 A * 12/1999 Tanaka et al. ..... 24/399
6,010,244 A 1/2000 Dobreski et al.
6,014,795 A 1/2000 McMahon et al.
6,088,887 A * 7/2000 Bois ..... 383/64 X
6,220,754 B1 * 4/2001 Stiglic et al. ..... 383/64
6,290,393 B1 * 9/2001 Tomic ..... 383/64 X
6,305,844 B1 * 10/2001 Bois ..... 383/64

* cited by examiner

RESEALABLE CLOSURE MECHANISM HAVING A SLIDER DEVICE

CLAIM TO PRIORITY UNDER 35 U.S.C. §119(e)

Priority under 35 U.S.C. §119(e) is claimed to provisional application serial No. 60/200,989, filed on May 1, 2000, and entitled "Resealable Closure Mechanism Having A Slider Device" and provisional application serial No. 60/226,507, filed on Aug. 21, 2000, and entitled "Resealable Closure Mechanism Having A Slider Device". The complete disclosure of application Nos. 60/200,989 and 60/226,507 are incorporated by reference herein.

FIELD

This disclosure generally relates to closure arrangements for polymer packages, such as, plastic bags. In particular, the present invention relates to resealable closure mechanisms or zipper-type closures for resealable packages.

BACKGROUND

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some types of resealable packages are opened and closed using a slider device. The slider device typically includes a separator or plow-type structure at one end that opens a closure mechanism, having profiled elements or closure profiles, when the slider device travels in a first direction along the mechanism. The sidewalls of the slider device are inwardly tapered from one end to the opposite end so that the sidewalls engage the closure profiles and progressively move them into engagement to close the resealable package when the slider device is moved along the closure mechanism in a direction opposite the first direction.

Concerns are raised regarding resealable closure mechanisms with slider devices. One such concern pertains to the installation of slider devices. Another concern is the plow design and the ability of the plow to effectively open the resealable closure mechanism. Another concern is containing product within the package. Therefore, improvements are desirable.

SUMMARY OF THE DISCLOSURE

In one aspect of the present disclosure, one example embodiment involves a closure arrangement for use with a flexible package. The closure arrangement includes a first closure mechanism, a slider device, and a second closure mechanism. The first closure mechanism includes selectively engageable first and second profiles. The slider device includes a housing operably mounted on the first closure mechanism. The slider housing is constructed and arranged to engage and disengage the first and second profiles. The slider housing defines a first cavity that slidably receives the first and second profiles. The second closure mechanism includes selectively engageable third and fourth profiles. The second closure mechanism is adjacent to the first closure mechanism but is completely outside of the first cavity.

In another aspect, another embodiment of the present disclosure involves a resealable package. The resealable package includes first and second panel sections joined together to define an enclosed region and a mouth that provides access to the enclosed region. The package also includes a closure arrangement secured to the first and second panel sections to selectively open and seal the mouth. The closure arrangement has structure analogous to the that described above.

In another aspect, the present disclosure describes a method of using a closure arrangement having first and second closure mechanisms and a slider device having a housing. The second closure mechanism is completely outside of the slider housing and the slider device is operably mounted on the first closure mechanism. The method includes sliding the slider device in a first direction to close the first and second closure mechanisms and sliding the slider device in a second direction opposite of the first direction to open at least the first closure mechanism.

DETAILED DESCRIPTION

Figure 1:
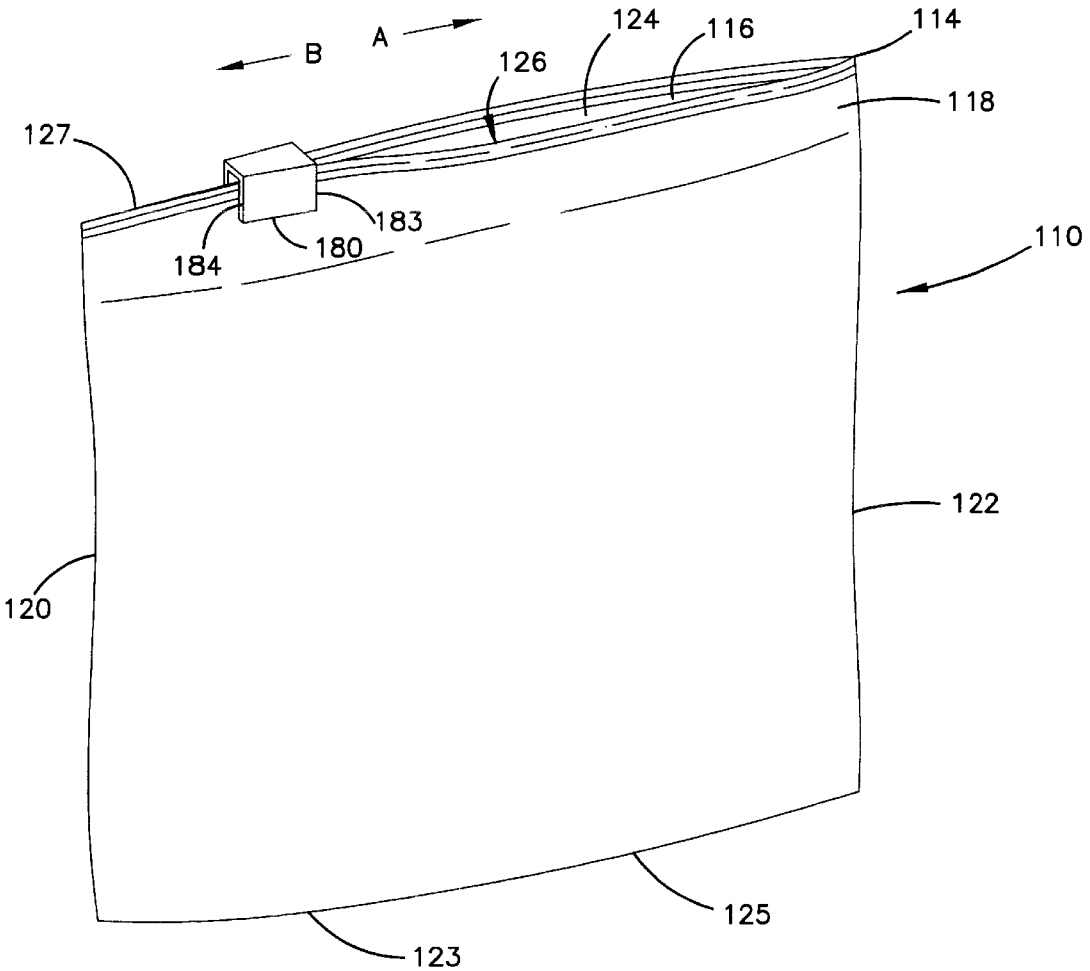
FIG. 1 is a perspective view of a flexible, resealable package having a slider device, according to an example embodiment of the present disclosure.

According to an example embodiment of the present disclosure, in general, a package includes a slider device having a plow and first and second resealable closure mechanisms. The plow is designed to effectively open the first resealable closure mechanism. The second resealable closure mechanism is designed to help contain product within the package. FIG. 1 illustrates an example type of package 110 that benefits from the use of principles of this disclosure.

FIG. 1 illustrates an example packaging arrangement in the form of a resealable, flexible package 110, for example, a polymer package such as a plastic bag. The flexible package 110 has a first resealable closure mechanism 114, for example, interlocking profiled elements, constructed in accordance with principles of this disclosure. The flexible package 110 includes first and second opposed panel sections 116, 118, typically made from a flexible, polymer, plastic film. For some manufacturing applications, the first and second panel sections 116, 118 are heat-sealed together along two side edges 120, 122 and meet at a fold line 123 in order to form a three-edged containment section for a product within an interior 124 of the package 110.

In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at the top edge 127 of the package. In the particular embodiment shown, the mouth 126 extends the width of the package 110.

The first resealable closure mechanism 114 is illustrated in FIG. 1 at the mouth 126 of the flexible package 110. In the embodiment shown, the first resealable closure mechanism 114 extends the width of the mouth 126. Alternatively, the first closure mechanism 114 could be positioned on the package 110 at a location different from the mouth 126 of the package 110, depending on the application needs for the package 110.

The first resealable closure mechanism 114 can be one of a variety of closure mechanisms. In the particular embodiment illustrated in FIG. 2, the first resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
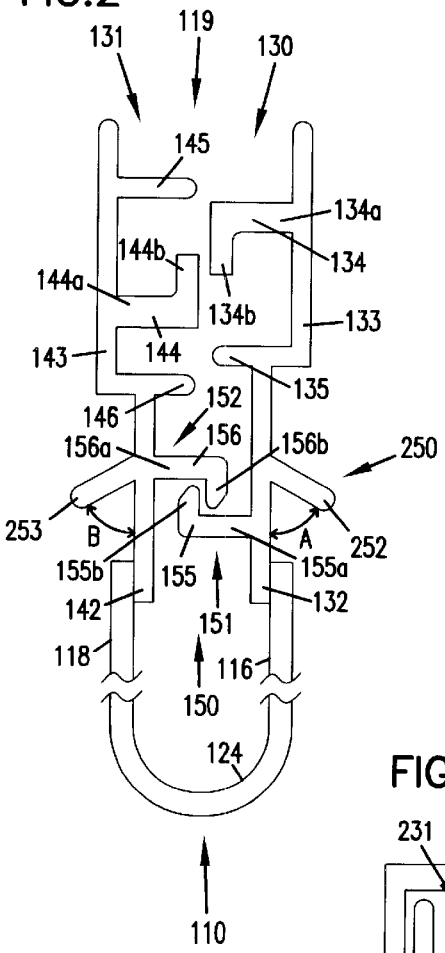
FIG. 2 is a fragmented, cross-sectional view of profiled elements secured to a flexible package, according to an example embodiment of the present disclosure.

In particular, the zipper-type closure mechanism in FIG. 2 is an illustration of one example of a mono-track closure mechanism. By the term "mono-track," it is meant that each profile has an interlocking hook or member for interlocking or interengaging. The first resealable closure mechanism 114 includes an elongated first closure profile 130 and an elongated second closure profile 131. Typically, the closure profiles 130, 131 are manufactured separately from each other. Alternatively, any simple or complex closure mechanism could be used, for example, a multi-track zipper-type closure mechanism.

Still in reference to FIG. 2, the first closure profile 130 includes a first bonding strip 132, a first base strip 133, a first closure member 134, and a first guide post 135. The first closure member 134 extends from the first base strip 133 toward the second closure profile 131 and is generally projecting from the first base strip 133. The first closure member 134 includes a first post 134*a* and a first hook 134*b*. In the embodiment illustrated, the first post 134*a* generally extends or projects from the first base strip 133, and the first hook 134*b* generally extends or projects from the first post 134*a*.

The first guide post 135 also extends from the first base strip 133 toward the second closure profile 131 and is generally projecting from the first base strip 133. The first guide post 135 aids in aligning the first closure member 134 for interlocking as will be explained in more detail below. Preferably, the first bonding strip 132 depends or extends downward from the first guide post 135 and is typically attached to a first panel section, such as the first panel section 116 of the package 110 of FIG. 1.

The second closure profile 131 likewise includes a second bonding strip 142, a second base strip 143, a second closure member 144, a second guide post 145, and a third guide post 146. The second closure member 144 extends from the second base strip 143 toward the first closure profile 130 and is generally projecting from the second base strip 143. The second closure member 144 includes a second post 144*a* and a second hook 144*b*. In the embodiment illustrated, the second post 144*a* generally extends or projects from the second base strip 143, and the second hook 144*b* generally extends or projects from the second post 144*a*.

The second and third guide posts 145, 146 also extend from the second base strip 143 toward the first closure profile 130 and are generally projecting from the second base strip 143. The second and third guide posts 145, 146 aid in aligning the second closure member 144 for interlocking as will be explained in more detail below. The second bonding strip 142 depends or extends downward from the third guide post 146 and is typically attached to a second panel section, such as the second panel section 118 of the package 110 of FIG. 1.

The first and second closure profiles 130, 131 are designed to engage with one another to form the resealable closure mechanism 114. The first closure member 134 of the first closure profile 130 extends from the base strip 133 a certain distance. The second closure member 144 of the second closure profile 131 also extends from the base strip 143, a certain distance. These certain distances, that the closure members 134, 144 extend, are sufficient to allow mechanical engagement, or interlocking, between the first closure member 134 of the first closure profile 130 and the second closure member 144 of the second closure profile 131.

In particular, the first hook 134*b* of the first closure member 134 interengages or interlocks with the second hook 144*b* of the second closure member 144. The first guide post 135 of the first closure profile 130 and the second and third guide posts 145, 146 of the second closure profile 131 aid in aligning the closure profiles 130, 131 and in keeping the closure profiles 130, 131 interlocked. Furthermore, the closure profiles 130, 131 are sealed together at their ends, such as side edges 120, 122 of FIG. 1, to further aid in aligning the closure profiles 130, 131 for interlocking. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126, FIG. 1.

In some applications, the closure profiles 130, 131 are formed by two separate extrusions or through two separate openings of the common extrusion. Typically, the resealable closure mechanism 114 is made of a polymer, plastic material, such as polyethylene or polypropylene. In one example embodiment, the closure arrangement illustrated in FIG. 2 is manufactured using conventional extrusion and heat sealing techniques.

Preferably, the package 110 also includes a second closure mechanism 150. The second closure mechanism 150 provides a supplemental, or back-up, seal for the first resealable closure mechanism 114 and is designed and constructed to aid in preventing undesirable amounts of product within the package 110 from passing through the mouth 126, FIG. 1, of the package 110.

Preferably, the second closure mechanism 150 is located below the first resealable closure mechanism 114. By the term "below," it is meant that the second closure mechanism 150 is located more toward the interior 124 of the package 110 than the first resealable closure mechanism 114. In other words, the second closure mechanism 150 is located between the first closure mechanism 114 and the bottom edge 125, FIG. 1, of the package 110.

In the embodiment illustrated in FIG. 2, the second closure mechanism 150 includes first and second closure profiles 151, 152. The first closure profile 151 includes a first closure member 155. The first closure member 155 extends from the first bonding strip 132 and is generally projecting from the first bonding strip 132. The first closure member 155 includes a first post 155*a* and a first hook 155*b*. In the embodiment illustrated, the first post 155*a* generally extends or projects from the first bonding strip 132, and the first hook 155*b* generally extends or projects from the first post 155*a*.

The second closure profile 152 includes a second closure member 156. The second closure member 156 extends from the second bonding strip 142 in a direction opposite that of the first closure member 155. The second closure member includes a second post 156*a* and a second hook 156*b*. In the embodiment illustrated, the second post 156*a* generally extends or projects from the second boding strip 142, and the second hook 156*b* generally extends or projects from the second post 156*a*.

The first and second closure profiles 151, 152 are designed and constructed to engage with one another to form the second closure mechanism 150. The first closure member 155 of the first closure profile 151 extends from the first bonding strip 132 a certain distance. The second closure member 156 of the second closure profile 152 also extends from the second bonding strip 142, a certain distance. These certain distances, that the first and second closure members 155, 156 extend, are sufficient to allow mechanical engagement, or interlocking, between the first closure member 155 of the first closure profile 151 and the second closure member 156 of the second closure profile 152. In particular, the first hook 155*b* of the first closure member 155 interengages or interlocks with the second hook 156*b* of the second closure member 156.

The second closure mechanism 150 preferably includes a gripping arrangement 250. The gripping arrangement 250 is designed and constructed to aid the user of the package in gripping the closure arrangement to open and close the second closure mechanism 150. In particular, the gripping arrangement 250 includes first and second gripper handles 252, 253. The first gripper handle 252 extends or projects from the first bonding strip 132. Likewise, the second gripper handle 253 extends or projects from the second bonding strip 142.

The first gripper handle 252 has a first angle A with respect to the first bonding strip 132. Preferably, the first angle A is at least 10 degrees, most preferably between 20 degrees and 90 degrees, and typically about 60 degrees. Likewise, the second gripper handle 253 has a second angle B with respect to the second bonding strip 142. Preferably, the second angle B is at least 10 degrees, most preferably between 20 degrees and 90 degrees, and typically about 60 degrees.

Typically, the first and second profiles 151, 152 of the second closure mechanism 150 are extruded with the first and second closure profiles 130, 131 of the first resealable closure mechanism 114. Alternatively, the first and second profiles 151, 152 of the second closure mechanism 150 are coextended from a different material than the first and second closure profiles 130, 131 of the first resealable closure mechanism 114.

Figure 3:
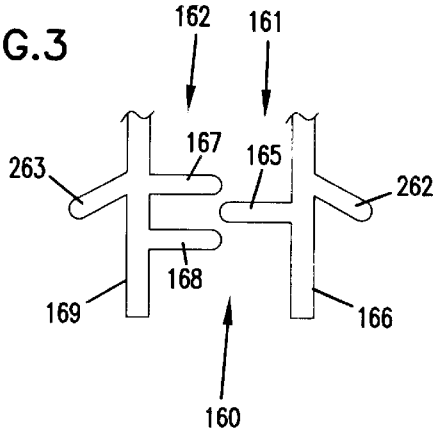
FIG. 3 is a fragmented, cross-sectional view of a second closure mechanism, according to an example embodiment of the present disclosure.

Attention is directed to FIG. 3. FIG. 3 is a fragmented, cross-sectional view of a second embodiment of a second closure mechanism 160. In the embodiment illustrated in FIG. 3, the second closure mechanism 160 includes first and second closure profiles 161, 162. The first closure profile 161 includes a first closure member 165. The first closure member 165 extends from a first bonding strip 166 and is generally projecting from the first bonding strip 166.

The second closure profile 162 includes second and third closure members 167, 168. The second and third closure members 167, 168 extend from a second bonding strip 169 in a direction opposite that of the first closure member 165.

The first and second closure profiles 161, 162 are designed and constructed to engage with one another to form the second closure mechanism 160. The first closure member 165 of the first closure profile 161 extends from the first bonding strip 166 a certain distance. The second and third closure members 167, 168 of the second closure profile 162 also extend from the second bonding strip 169 a certain distance. These certain distances, that the first, second, and third closure members 165, 167, 168 extend, are sufficient to allow frictional engagement between the first closure member 165 of the first closure profile 161 and the second and third closure members 167, 168 of the second closure profile 162. In other words, the first closure member 165 fits tightly or snuggly between the second and third closure members 167, 168. In particular, the first closure member 165 engages between the first and second closure members 167, 168.

Preferably, the second closure mechanism 160 includes first and second gripper handles 262, 263 analogous to the first and second gripper handles 252, 253 of FIG. 2.

Figure 4:
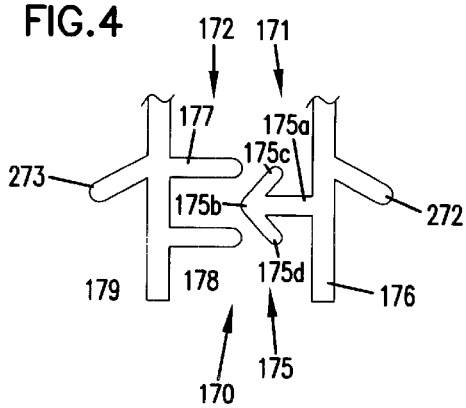
FIG. 4 is a fragmented, cross-sectional view of a second closure mechanism, according to another example embodiment of the present disclosure.

Attention is directed to FIG. 4. FIG. 4 is a fragmented, cross-sectional view of a third embodiment of a second closure mechanism 170. In the embodiment illustrated in FIG. 4, the second closure mechanism 170 includes first and second closure profiles 171, 172. The first closure profile 171 includes a first closure member 175. The first closure member 175 extends from a first bonding strip 176 and is generally projecting from the first bonding strip 176. The first closure member 175 includes a first post 175*a* and a first engaging member 175*b*. In the embodiment illustrated, the first post 175*a* generally extends or projects from the first bonding strip 176, and the first engaging member 176*b* generally extends or projects from the first post 175*a*. In general, the first engaging member 175*b* has an arrow type shape as illustrated in FIG. 4. The first engaging mechanism 175*b* includes first and second wing members 175*c*, 175*d*.

The second closure profile 172 includes second and third closure members 177, 178. The second closure profile 172 has structure analogous to the second closure profile 162 of FIG. 3.

The first and second closure profiles 171, 172 are designed and constructed to engage with one another to form the second closure mechanism 170. The first closure member 175 of the first closure profile 171 extends from the first bonding strip 176 a certain distance. The second and third closure members 177, 178 of the second closure profile 172 also extend from a second bonding strip 179 a certain distance. These certain distances, that the first, second, and third closure members 175, 177, 178 extend, are sufficient to allow mechanical engagement, or interlocking, between the first closure member 175 of the first closure profile 171 and the second and third closure members 177, 178 of the second closure profile 172. The first closure member 175 engages between the first and second closure members 177, 178. The first engaging member 175*b* is designed and constructed to aid in keeping the first and second closure profiles 171, 172 interlocked. In particular, the first and second wing members 175*c*, 175*d* aid in preventing the first and second closure profiles 171, 172 from disengaging.

Preferably, the second closure mechanism 170 includes first and second gripper handles 272, 273 analogous to the first and second gripper handles 252, 253 of FIG. 2.

Figure 5:
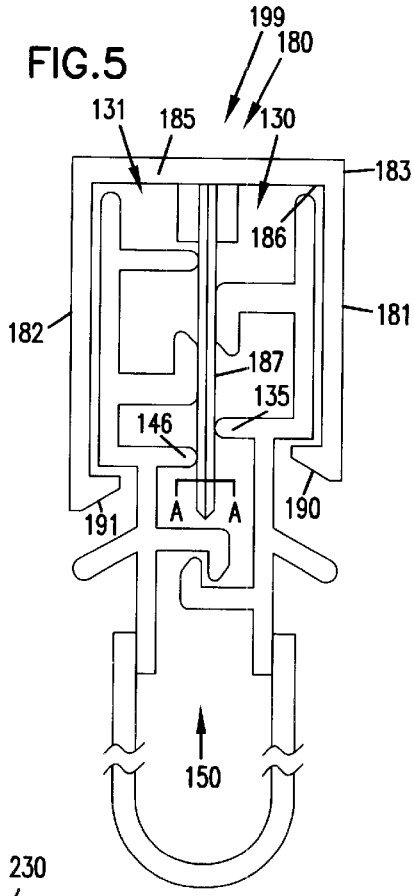
FIG. 5 is a fragmented, cross-sectional view of the profiled elements secured to a flexible package having a slider device attached, according to an example embodiment of the present disclosure.

Referring back to FIG. 1, a slider device 180 opens and closes the first resealable closure mechanism 114 and the second closure mechanism 150. Attention is directed to FIG. 5. The slider device 180 has a housing 199 defining a first cavity 186 that receives the first and second closure profiles 130, 131 of FIG. 2. While the housing 199 can have a number of shapes in the embodiment illustrated, the housing 199 includes first and second sidewalls 181, 182, a first end 183, a second opposite end 184, FIG. 1, and a rigid top wall 185 extending between the first and second sidewalls 181, 182. By the term "rigid," it is meant that the top wall 185 is stiff and relatively inflexible. Preferably, the second closure mechanism 150 is completely outside of the first cavity 186 of the slider device 180. By the term "completely outside," it is meant that the second closure mechanism 150 is below the first and second sidewalls 181, 182 of the slider device 180, or in other words the second closure mechanism 150 does not overlap any portion of the slider device 180.

The slider device 180 further includes a separator or plow 187. In the embodiment shown, the plow 187 depends or extends down from the top wall 185 of the slider device 180 into the cavity 186. In preferred embodiments, the plow 187 is located at the first end 183 of the slider device 180 and extends only partially along the length of the slider device 180. That is, the plow 187 only extends approximately 30 to 50% of the length of the slider device 180 beginning at the first end 183. Preferably, the plow 187 does not exist at the second end 184 of the slider device 180. This is because the plow 187 separates the closure profiles 130, 131, but the second end 184 of the slider device is designed and constructed to engage the first and second closure profiles 130, 131.

Confronting portions of the sidewalls 181, 182 are tapered towards each other from the first end 183 towards the second end 184, as shown in FIG. 1. Thus, referring back to FIG. 1, when the slider device 180 is moved in a first, sealing direction A along the top edge 127 of the package 110, the tapered shapes of the sidewalls 181, 182, FIG. 5, of the slider device 180 apply pressure to the first and second closure profiles 130, 131, FIG. 5, pinching them together behind the slider device 180 as the slider device 180 moves forward. Interlocking the closure profiles 130, 131 of the resealable closure mechanism 114 seals the mouth 126 of the package 110, preventing the contents of the package 110 from spilling out.

Preferably, the slider device 180 also closes the second closure mechanism 150. Thus, when the slider device 180 is moved in the first, sealing direction A along the top edge 127 of the package 110, the bonding strips 132, 142 are rigid enough that the slider device 180 also applies pressure to the first and second closure profiles 151, 152 of the second closure mechanism 150 to cause the first and second closure profiles 151, 152 to interlock.

The plow 187, FIG. 3, separates the closure profiles 130, 131, FIG. 3, when the slider device 180 is moved in a second, opposite, opening direction B along the top edge 127 of the package 110. The plow 187 forces the closure profiles 130, 131 apart, providing access to the contents of the package 110 through the mouth 126.

Still in reference to FIG. 1, generally, to seal the package 110, a package user slides the slider device 180 in the sealing direction A across the top of the package 110. The tapered sidewalls 181, 182, FIG. 5, apply pressure to the closure profiles 130, 131 interlocking them as the slider device 180 travels in the sealing direction A. When the slider device 180 is proximate to the side edge 122, the mouth 126 of the package 110 is sealed closed. Generally to open the package 110, the package user slides the slider device 180 in the opposite, opening direction B. The plow 187, FIG. 5, separates the closure profiles 130, 131, opening the resealable closure mechanism 114.

Sometimes, in some embodiments, the plow 187 of the slider device 180 might keep the first and second closure profiles 130, 131 from completely engaging along the entire length of the first closure mechanism 114 when the slider device 180 is in the closed position. Referring to FIG. 1, by the term "closed position," it is meant that the slider device 180 has traveled in the sealing direction A and has come to rest proximate to the side edge 122 of the package 110. In this position, the plow 187, FIG. 5, might keep the first and second closure profiles 130, 131 from engaging near the side edge 122 of the package 110. The secondary closure mechanism 150 is designed to ensure that the mouth 126 of the package 110 of FIG. 1 is substantially leak-proof even though the first closure mechanism 114 may not be completely sealed in the closed position.

Figure 6:
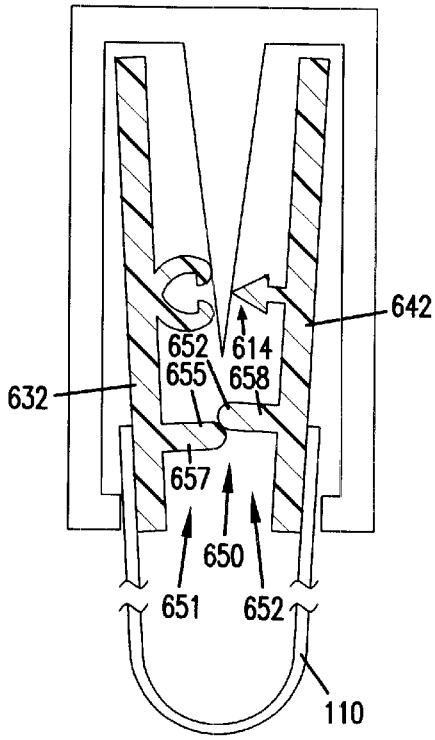
FIG. 6 is a cross-sectional view of profiled elements secured to a flexible package, according to an example embodiment of the present disclosure.

Attention is directed to FIG. 6. FIG. 6 is another embodiment of a first resealable closure mechanism 614 and a second reseasable closure mechanism 650 usable in accordance with principles described herein. The embodiment illustrated in FIG. 6 is usable with any slider device, such as those described herein. The first resealable closure mechanism 614 illustrated is a mono-track resealable closure mechanism that has structure analogous to the first resealable closure mechanism 114 of FIG. 2.

The second closure mechanism 650 provides a supplemental, or back-up, seal for the first resealable closure mechanism 614 and is designed and constructed to aid in preventing undesirable amounts of product within the package 110 from passing through the mouth 126, FIG. 1, of the package 110. Preferably, the second closure mechanism 650 is located below the first resealable closure mechanism 614.

In the embodiment illustrated in FIG. 6, the second closure mechanism 650 includes first and second closure profiles 651, 652. The first closure profile 651 includes a first closure member 655. The first closure member 655 extends from a first base strip 632 and is generally projecting from the first base strip 632. The first closure member 655 includes a first post 657.

The second closure profile 652 includes a second closure member 656. The second closure member 656 extends from a second base strip 642 in a direction opposite that of the first closure member 655. The second closure member 656 includes a second post 658.

The first and second closure profiles 651, 652 are designed and constructed to overlap one another to form the second closure mechanism 650. The first closure member 655 of the first closure profile 651 extends from the first base strip 632 a certain distance. The second closure member 656 of the second closure profile 652 also extends from the second base strip 642, a certain distance. These certain distances, that the first and second closure members 655, 656 extend, are sufficient to allow the first and second posts 657, 658 of the first and second closure profiles 651, 652, respectively, to overlap each other to form the second closure mechanism 650.

Figure 7:
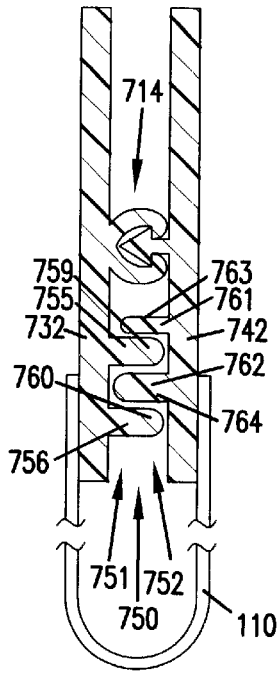
FIG. 7 is a cross-sectional view of profiled elements secured to a flexible package, according to an example embodiment of the present disclosure.

Attention is directed to FIG. 7. FIG. 7 is another embodiment of a first resealable closure mechanism 714 and a second reseasable closure mechanism 750 usable in accordance with principles described herein. Although not depicted in FIG. 7, the embodiment illustrated in FIG. 7 is usable with any slider device, such as those described herein. The first resealable closure mechanism 714 illustrated is a mono-track resealable closure mechanism that has structure analogous to the first resealable closure mechanism 114 of FIG. 2.

The second closure mechanism 750 provides a supplemental, or back-up, seal for the first resealable closure mechanism 714. In the embodiment illustrated in FIG. 7, the second closure mechanism 750 includes first and second closure profiles 751, 752. The first closure profile 751 includes a first closure member 755 and a second closure member 756. The first and second closure members 755, 756 extend from a first base strip 732 and are generally projecting from the first base strip 732. The first closure member 755 includes a first post 759. Likewise, the second closure member 756 includes a second post 760.

The second closure profile 752 includes a third closure member 761 and a fourth closure member 762. The third and fourth closure members 761, 762 extend from a second base strip 742 in a direction opposite that of the first and second closure members 755, 756. The third closure member 761 includes a third post 763. Likewise, the fourth closure member 762 includes a fourth post 764.

The first and second closure profiles 751, 752 are designed and constructed to overlap one another to form the second closure mechanism 750. The first and second closure members 755, 756 of the first closure profile 751 extend from the first base strip 732 a certain distance. The third and fourth closure members 761, 762 of the second closure profile 752 also extend from the second base strip 742, a certain distance. These certain distances, that the closure members 755, 756, 761, 762 extend, are sufficient to allow the posts 759, 760, 763, 764 of the first and second closure profiles 751, 752, respectively, to overlap each other to form the second closure mechanism 750.

Figure 8:
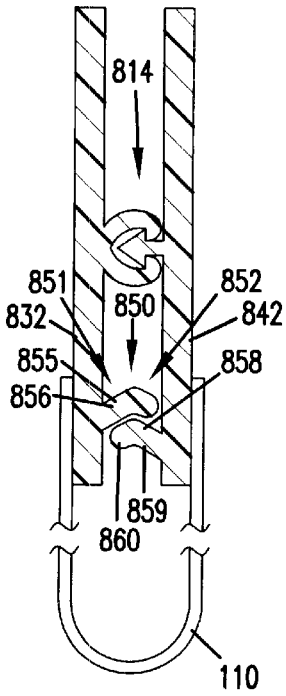
FIG. 8 is a cross-sectional view of profiled elements secured to a flexible package, according to an example embodiment of the present disclosure.

Attention is directed to FIG. 8. FIG. 8 is another embodiment of a first resealable closure mechanism 814 and a second reseasable closure mechanism 850 usable in accordance with principles described herein. Although not depicted in FIG. 8, the embodiment illustrated in FIG. 8 is usable with any slider device, such as those described herein. The first resealable closure mechanism 814 illustrated is a mono-track resealable closure mechanism that has structure analogous to the first resealable closure mechanism 114 of FIG. 2.

The second closure mechanism 850 provides a supplemental, or back-up, seal for the first resealable closure mechanism 814. In the embodiment illustrated in FIG. 8, the second closure mechanism 850 includes first and second closure profiles 851, 852. The first closure profile 851 includes a first closure member 855. The first closure member 855 extends from a first base strip 832 and is generally projecting from the first base strip 832. The first closure member 855 includes a first post 856 and a first hook portion 857.

The second closure profile 852 includes a second closure member 858. The second closure members 858 extends from a second base strip 842 in a direction opposite that of the first closure member 855. The second closure member 858 includes a second post 859 and a second hook portion 860.

The first and second closure profiles 851, 852 are designed and constructed to engage with one another to form the second closure mechanism 850. The first closure member 855 of the first closure profile 851 extends from the first base strip 832 a certain distance. The second closure member 858 of the second closure profile 852 also extends from the second base strip 842, a certain distance. These certain distances, that the closure members 855, 858 extend, are sufficient to allow the first and second hook portions 857, 860 of the first and second closure profiles 851, 852, respectively, to mechanically engage with each other to form the second closure mechanism 850.

Alternatively, any suitable number of closure members or posts could be used for the second resealable closure mechanism. In addition, any suitable shape could be used for the closure members of the second resealable closure mechanism. Furthermore, the secondary closure mechanism may be any single or multi-track zipper-type closure mechanism.

Figure 9:
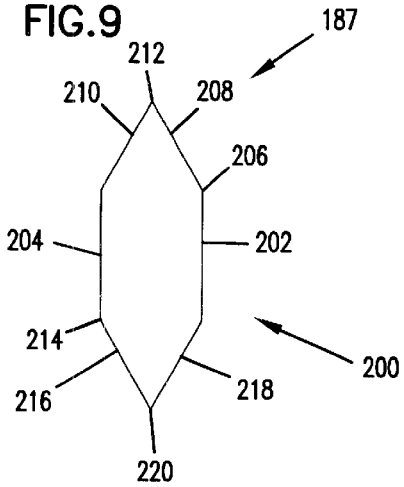
FIG. 9 is a cross-sectional view of a plow of the slider device of FIG. 5 taken along the line A—A of FIG. 5, according to an example embodiment of the present disclosure.

Preferably, the plow 187, FIG. 5, has a cross-sectional shape that aids in, or facilitates, the opening and closing of the first resealable closure mechanism. Attention is directed to FIG. 9. FIG. 9 is a cross-section taken along line A—A of the plow 187 of FIG. 5. In the embodiment illustrated in FIG. 9, the plow 187 has a non-rectangular, e.g., a polygonal cross-sectional first shape 200, generally having a diamond-like shape. Preferably, the first shape 200 has a first edge 202 and a second, parallel edge 204. The first and second edges 202, 204 are joined at a first end 206 by converging third and fourth edges 208, 210 that converge at a point 212. Likewise, the first and second edges 202, 204 are joined at a second end 214 by converging fifth and sixth edges 216, 218 that converge at a point 220. The third and fourth edges 208, 210 and fifth and sixth edges 216, 218 have a generally triangular shape. The converging edges 208, 210, 216, 218 aid in operation of the slider device 180. The converging points 212, 220 help to separate the closure profiles 130, 131 as the slider device 180 is slid along the top edge 127 of the package 110.

Figure 10:
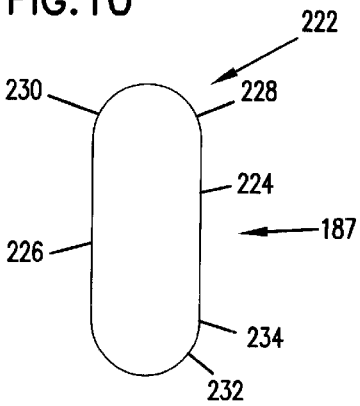
FIG. 10 is a cross-sectional view of a second embodiment of a plow of the slider device of FIG. 5, the cross-section being analogous to the cross-section taken along line A—A of FIG. 5, according to another example embodiment of the present disclosure.

Attention is directed to FIG. 10. FIG. 10 is a second example embodiment of a cross-sectional second shape 222 of the plow 187, taken along lines A—A of FIG. 5.

The second shape 222 is non-rectangular or generally race-track shaped. The second shape 222 has first and second parallel side edges 224, 226. The first and second side edges 224, 226 are joined by a first half-circular edge 228 at a first end 230 and by a second half-circular edge 232 at a second end 234.

Figure 11:
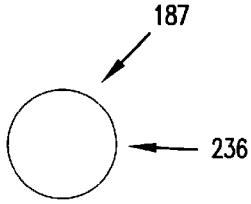
FIG. 11 is a cross-sectional view of a third embodiment of a plow of the slider device of FIG. 5, the cross-section being analogous to the cross-section taken along line A—A of FIG. 5, according to another example embodiment of the present disclosure.

Attention is directed to FIG. 11. FIG. 11 is a third example embodiment of a cross-sectional third shape 236 of the plow 187, taken along lines A—A of FIG. 5. The third shape 236 is non-rectangular or generally circular, or in other words, in this embodiment the plow 187 is generally cylindrical.

In the embodiment illustrated in FIG. 5, the first sidewall 181 includes a first shoulder 190. Likewise, the second sidewall 182 includes a second shoulder 191. The first and second shoulders 190, 191 are designed and constructed to fit under the first and third guide posts 135, 146 respectively. During installation of the slider device 180, the sidewalls typically 181, 182 deflect outward, or away, from each other as the slider device 180 is pushed over the first resealable closure mechanism 114. As the slider device 180 is pushed downward onto the package 110, the first and second shoulders 190, 191 fit under the first and third guide posts 135, 146, respectively, retaining the slider device 180 on the package 110.

Figure 12:
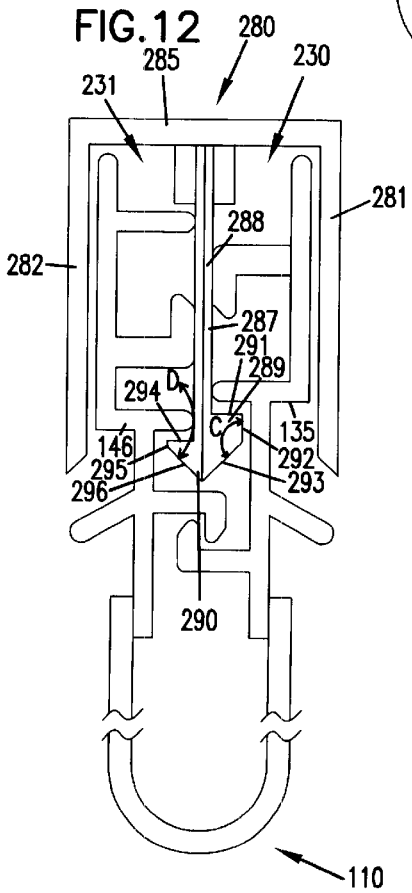
FIG. 12 is a fragmented, cross-sectional view of the profiled elements secured to a flexible package having a slider device attached, according to another example embodiment of the present disclosure.

Attention is directed to FIG. 12. FIG. 12 is a fragmented, cross-section of a second embodiment of a slider device 280. The slider device 280 includes first and second sidewalls 281, 282. The slider device 280 also includes a plow 287. In the embodiment illustrated in FIG. 12, the plow 287 includes first and second shoulders 289, 290, analogous in function to the shoulders 190, 191 of the slider device 180 of FIG. 5. The first and second shoulders 289, 290 are designed and constructed to fit under the first and third guide posts 135, 146, respectively, retaining the slider device 280 on the package 110.

In the particular embodiment illustrated, the plow 287 includes a column 288 extending from and being cantilevered from the top wall 285 of the slider device 280. At the free end of the column 288 is the first and second shoulders 289, 290. The first shoulder 289 generally extends or projects from the column 288 toward the first closure profile 230. The first shoulder 289 includes a first edge 291, generally perpendicular to the column 288; a second edge 292, generally parallel to the column 288; and a third edge 293, extending between the second edge 292 and the column 288 at an angle C with respect to the second edge 292. Preferably, the angle C is at least 90 degrees, most preferably between 100 degrees and 170 degrees, and typically about 135 degrees.

Likewise, the second shoulder 290 generally extends or projects from the column 288 toward the second closure profile 231. The second shoulder 290 includes a first edge, generally perpendicular to the column 288; a second edge 295, generally parallel to the column 288; and a third edge 296, extending between the second edge 295 and the column 288 at an angle D with respect to the second edge 295. Preferably, the angle D is greater than 90 degrees, most preferably between 100 degrees and 170 degrees, and typically about 135 degrees.

The first and second shoulders 289, 290 might have any suitable cross-sectional shape, such as the cross-sectional shapes illustrated in FIGS. 9–11.

The above specification and examples are believed to provide a complete description of the manufacture and use of particular embodiments of the invention. Many embodiments can be made.

We claim:

1. A closure arrangement for use with a flexible package, the closure arrangement comprising:

(a) a first closure mechanism including selectively engageable first and second profiles;

(b) a slider device having a housing operably mounted on the first closure mechanism; the slider housing being constructed and arranged to engage and disengage the first and second profiles, the slider housing defining a first cavity that slidably receives said first and second profiles, and the slider housing includes a top wall, first and second sidewalls depending from the top wall, and a plow depending from the top wall for selectively disengaging at least the first and second profiles; and c) a second closure mechanism including selectively engageable third and fourth profiles, the second closure mechanism being adjacent to the first closure mechanism and outside of the first cavity.

2. A closure arrangement according to claim 1, wherein:

(a) said third profile includes a first closure member; and (b) said fourth profile includes a second closure member.

3. A closure arrangement according to claim 2, wherein:

(a) said first closure member includes a first post; and (b) said second closure member includes a second post.

4. A closure arrangement according to claim 3, wherein:

(a) said first closure member includes a first hook portion; and (b) said second closure member includes a second hook portion.

5. A closure arrangement according to claim 1, wherein:

(a) said first profile includes a first plurality of closure members; and (b) said second profile includes a second plurality of closure members.

6. A closure arrangement according to claim 5, wherein:

(a) said first plurality of closure members includes a first plurality of posts; and (b) said second plurality of closure members includes a second plurality of posts.

7. A closure arrangement according to claim 1 wherein:

(a) the first sidewall includes a first shoulder to retain the slider housing on the first profile; and (b) the second sidewall includes a second shoulder to retain the slider housing on the second profile.

8. A closure arrangement according to claim 1 wherein:

(a) the third closure profile includes a first interlocking member having a first post and a first hook;

(b) the fourth closure profile includes a second interlocking member having a second post and a second hook; and (c) wherein the first and second hooks arc designed and constructed to selectively interlock.

9. A closure arrangement according to claim 8 wherein:

(a) the first closure profile includes a third interlocking member having a third post and a third hook;

(b) the second closure profile includes a fourth interlocking member having a fourth post and fourth hook; and (c) wherein the third and fourth hook are designed and constructed to selectively interlock.

10. A resealable package comprising:

(a) first and second panel sections joined together to define an enclosed region; and a mouth providing access to the enclosed region; and (b) a closure arrangement secured to the first and second panel sections to selectively open and scal the mouth; the closure arrangement including:

(i) a first closure mechanism including selectively engageable first and second profiles;

(ii) a slider device having a housing operably mounted on the first closure mechanism; the slider housing being constructed and arranged to engage and disengage the first and second profiles, the slider housing defining a first cavity that slidably receives said first and second profiles, and the slider housing includes a lop wall, first and second sidewalls depending from the top wall, and a plow depending from the top wall for selectively disengaging the first and second profiles; and (iii) a second closure mechanism including selectively engageable third and fourth profiles positioned between the first closure mechanism and the enclosed region, and the second closure mechanism being outside of the first cavity.

11. A resealable package according to claim 10, wherein:

(a) said third profile includes a first closure member; and (b) said fourth profile includes a second closure member.

12. A resealable package according to claim 11, wherein:

(a) said first closure member includes a first post; and (b) said second closure member includes a second post.

13. A resealable package according to claim 12, wherein:

(a) said first closure member includes a first hook portion; and (b) said second closure member includes a second hook portion.

14. A resealable package according to claim 10, wherein:

(a) said first profile includes a first plurality of closure members; and (b) said second profile includes a second plurality of closure members.

15. A resealable package according to claim 14, wherein:

(a) said first plurality of closure members includes a first plurality of posts; and (b) said second plurality of closure members includes a second plurality of posts.

16. A resealable package according to claim 10 wherein:

(a) the third closure profile includes a first interlocking member having a first post and a first hook;

(b) the fourth closure profile includes a second interlocking member having a second post and a second hook; and (c) wherein the first and second hooks are designed and constructed to selectively interlock.

17. A resealable package according to claim 10 wherein:

(a) the first closure profile includes a third interlocking member having a third post and a third hook;

(b) the second closure profile includes a fourth interlocking member having a fourth post and fourth hook; and (c) wherein the third and fourth hook are designed and constructed to selectively interlock.

18. A method of using a closure arrangement having first and second closure mechanisms and a slider device having a housing with a plow, the second closure mechanism being completely outside of the slider housing, the slider device being operably mounted on the first closure mechanism, the method comprising:

(a) sliding the slider device in a first direction to close the first and second closure mechanisms; and (b) sliding the slider device in a second direction opposite of the first direction to cause the plow to open the first and second closure mechanism.

* * * * *

UNITED STATES PATENT AND TRADEMARK OFFICE

CERTIFICATE OF CORRECTION

PATENT NO. : 6,461,042 B1
DATED : October 8, 2002
INVENTOR(S) : Mladomir Tomic et al.

It is certified that error appears in the above-identified patent and that said Letters Patent is hereby corrected as shown below:

Column 12,
Line 33, insert --are -- and delete “arc”.
Line 47, insert -- seal -- and delete “scal”.
Line 57, insert -- top -- and delete “lop”.

Signed and Sealed this

Eighteenth Day of October, 2005

JON W. DUDAS
*Director of the United States Patent and Trademark Office*